United States Patent [19]

Volpi

[11] Patent Number: 4,662,675

[45] Date of Patent: May 5, 1987

[54] FOLDING SEATS, BENCHES AND TABLES

[76] Inventor: Giuseppe Volpi, 19 Panxworth Road, Hemel Hempstead, Hertfordshire, England

[21] Appl. No.: 786,603

[22] Filed: Oct. 11, 1985

[30] Foreign Application Priority Data

Oct. 13, 1984 [GB] United Kingdom ..... 8425934

[51] Int. Cl.[4] ..... A47B 85/04

[52] U.S. Cl. ..... 297/124; 297/320; 297/126

[58] Field of Search ..... 297/124, 122, 21, 22, 297/320, 126

[56] References Cited

U.S. PATENT DOCUMENTS

| | | | |
|---|---|---|---|
| 2,120,183 | 6/1938 | Mearkle | 297/22 X |
| 2,481,935 | 9/1949 | Larson | 297/124 X |
| 2,550,811 | 5/1951 | Herbert | 297/124 |
| 2,675,061 | 4/1954 | Erskine | 297/320 |

FOREIGN PATENT DOCUMENTS

| | | | |
|---|---|---|---|
| 189768 | 5/1957 | Australia | 297/21 |
| 232042 | 1/1960 | Australia | 297/124 |

*Primary Examiner*—Francis K. Zugel

*Attorney, Agent, or Firm*—Diller, Ramik & Wight

[57] ABSTRACT

A folding seat/table arrangement has transverse seat members (10,12) and transverse backrest/table top members (14,16) carried on transversely-spaced folding frames (18). In those frames, backrest supports (34) are pivotable relative to seat member carriers (30) between first and second stable end positions, by virtue of connecting links (38) which connect said supports (34) to rear seat legs (24). In one position (as shown) the backrest transverse members (14,16) are supported as an upright backrest for seated persons. In the other position, the backrest transverse members (14,16) are supported by props (48) from rearwardly-inclined backrest supports (34), in a horizontal table-top posture.

32 Claims, 9 Drawing Figures

FOLDING SEATS, BENCHES AND TABLES

Figure 1:
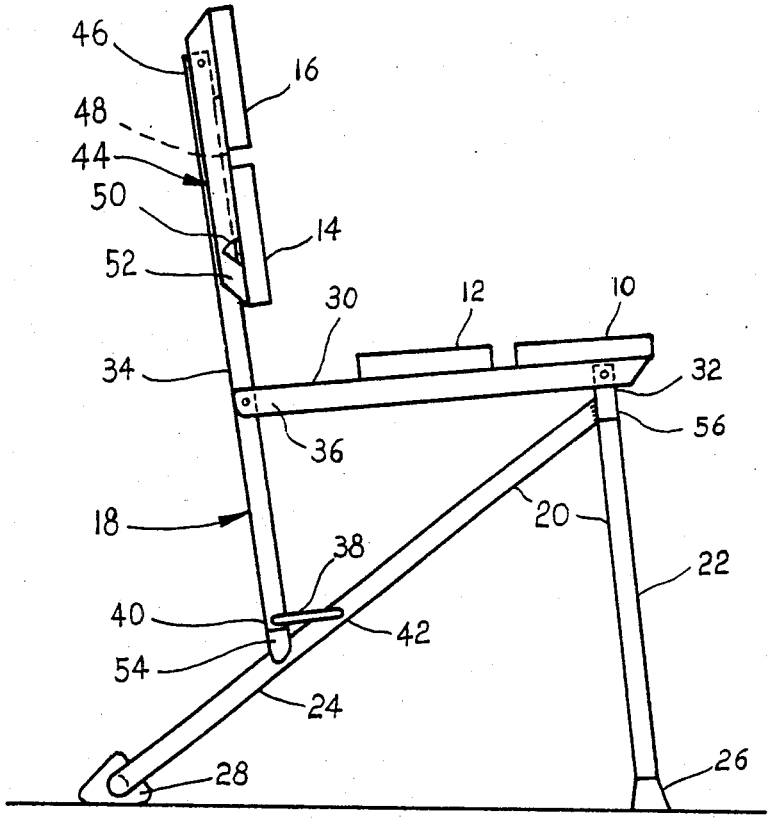

This invention relates to seats, benches, tables and similar articles, all of the folding or collapsible kind, that is, the kind in which the article may be folded or collapsed from an operative or functional condition to a storage condition for facilitating storage and/or transport of such articles. Such articles comprise a transverse seat or table member carried on a folding or collapsible framework.

Such folding articles are commonly, though not exclusively, purchased for use out-of-doors, for example, in the garden, or in the countryside for picnic purposes.

Eace of converting such articles from one said condition to the other is important to the user; but in addition such articles should desirably occupy a very small space when stored away.

Moreover, such folding articles are single-purpose articles, being constructed so as to serve but a single function, e.g. that of a seat, or a chair or table. Hence, such articles serving different functions are purchased for use in association with one another. This requires greater storage space to be available for storing all such single-purpose articles when not in use.

The present invention seeks to provide a multi-purpose folding article that can serve alternatively as a seat, or as a combined seat and table, is simple to erect for either purpose, occupies a very small storage space when collapsed, and is easily handled when in the collapsed condition.

According to the present invention, there is provided a seat of the folding or collapsible kind in which a transverse seat member is carried on a folding framework, which framework comprises at least two similar folding frames, each of which frames comprises:

(a) a leg member incorporating a front leg and a rear leg, which legs are secured together at one end, define between them a large acute angle, and have at their other ends respective ground-engaging foot portions which are spaced apart from one another to define the base area of the seat;

(b) a seat member carried for receiving and supporting said transverse seat member, said carrier being pivotally connected to said leg member near the junction of the front and rear legs;

(c) a backrest support pivotally connected intermediate its extremities to said seat member carrier at a position thereon remote from its pivotal connection with the leg member and over-hanging said rear leg:

(d) a connecting link pivotally connected at one end thereof to said rear leg at a position thereon remote from its respective extremities, and at the other end thereof to said backrest support at a position near the free end thereof which lies adjacent said rear leg, so as to allow the link to pivot between and occupy alternatively one of two alternative, stable end positions in which said free end of the backrest support compressively rests on said rear leg.

(e) a backrest carrier pivotally connected near one end thereof to said backrest support at or near a free end thereof which lies remote from said seat member carrier and said connecting link; and (f) a prop pivotally connected to said backrest carrier at a position thereon remote from its pivotal connection with said backrest support, and free to pivot between alternative first and second end positions, said prop when in said first end position lying adjacent the backrest carrier, and when in said second end position lying with its free end abutting and stably engaging the backrest support; said transverse seat member being secured to and carried by each said seat member carrier at a position thereon such that the centre of gravity of that seat member lies at a position intermediate the pivotal connections of each seat member carrier with its associated leg member and backrest support respectively; and a transverse backrest member being secured to and carried by each said backrest carrier at a position thereon such that the centre of gravity of the backrest member lies at a position intermediate the pivotal connections of each said backrest carrier with its associated backrest support and prop respectively.

Other features of the present invention will appear from the description that follows hereafter, and from the claims that are appended at the end of that description.

Figure 2:
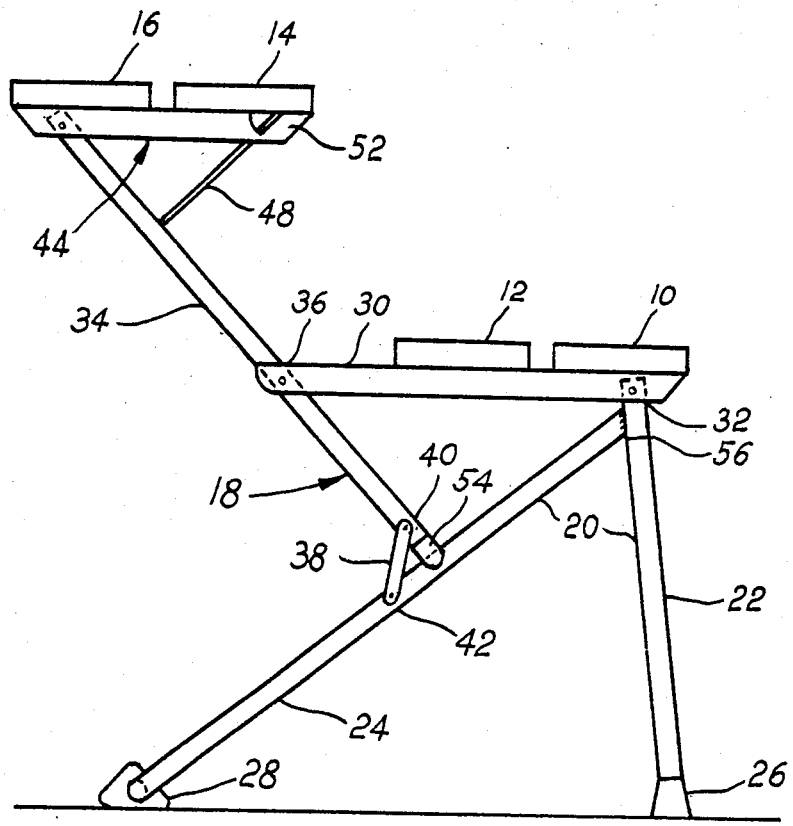
Figure 3:
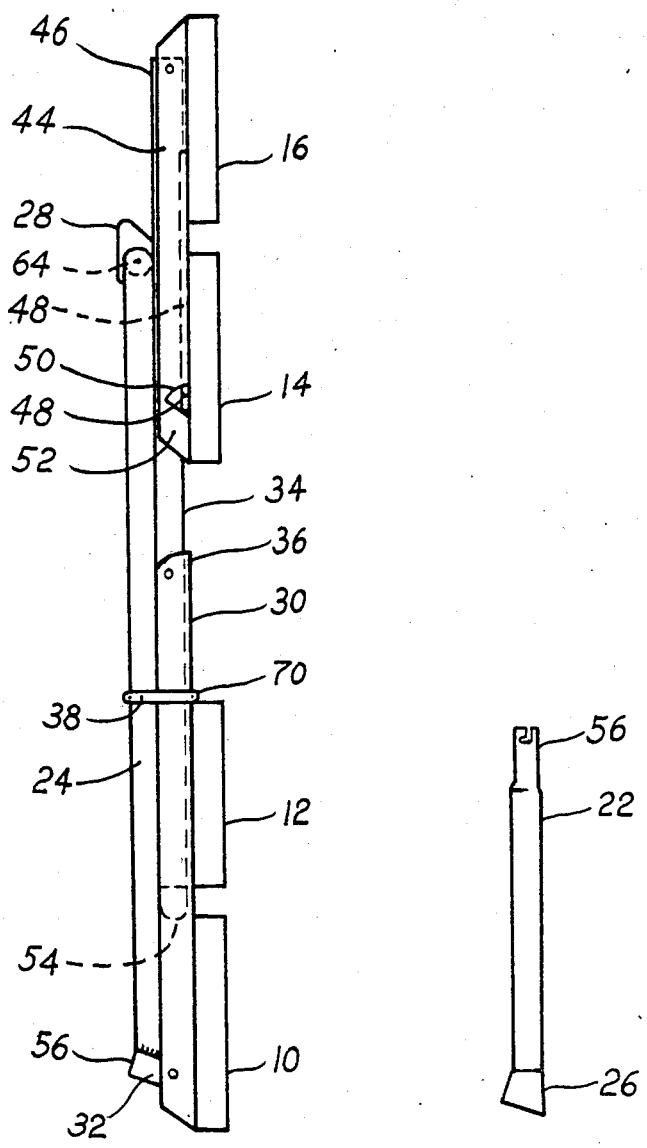

One bench seat according to the present invention will now be described by way of example, and with reference to the accompanying diagrammatic drawings, in which:

FIGS. 1 to 3 show diagrammatic end elevations of the seat when arranged in three different modes respectively. In FIG. 1, the seat is shown in its normal functional role as a seat with an upright backrest. In FIG. 2, the seat is shown transformed into a combined seat and table arrangement, the seat having no backrest. In FIG. 3, the seat is shown collapsed into a storage condition with its front legs detached for separate storage.

Figure 4:
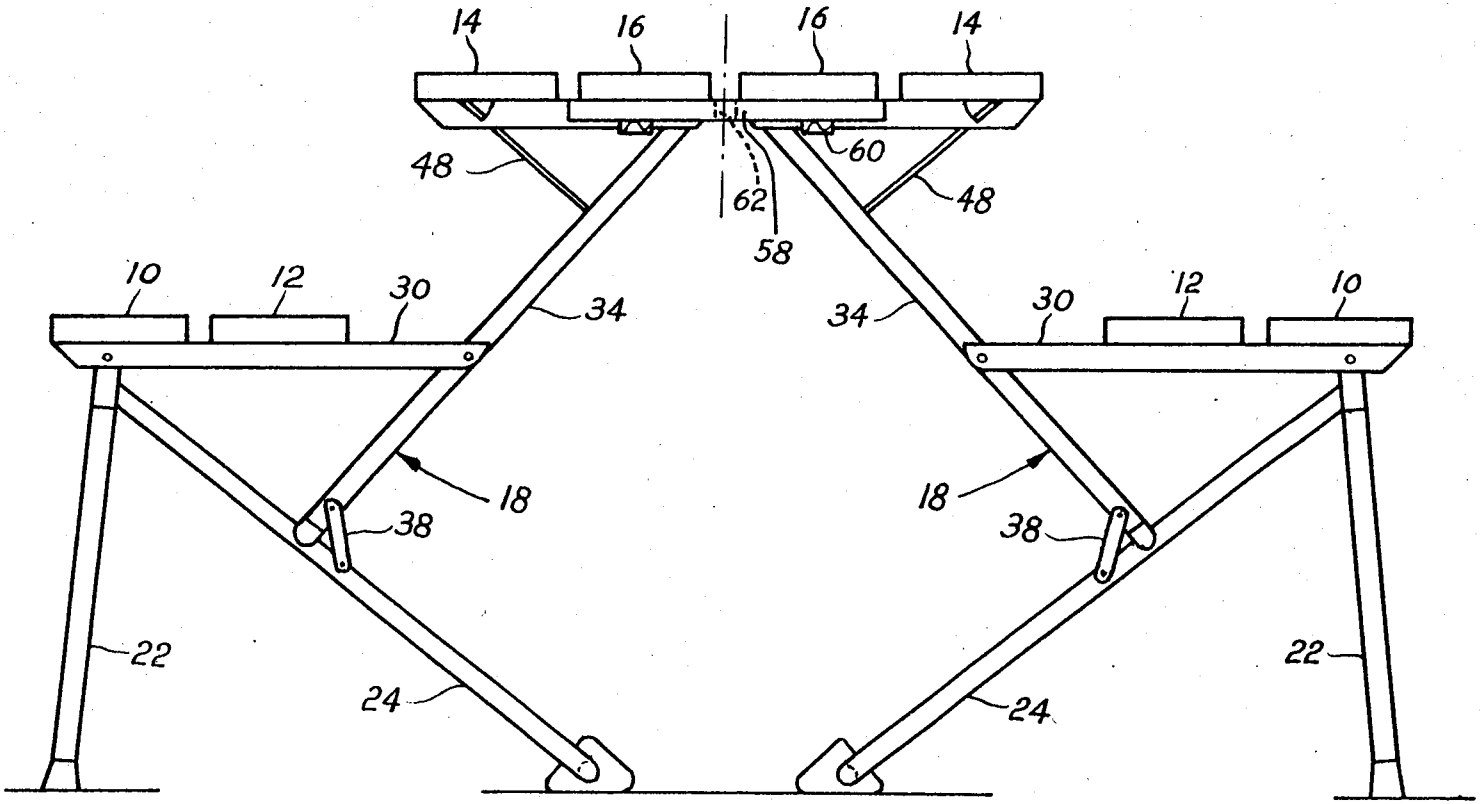

FIG. 4 shows a diagrammatic end elevation of two seat/table arrangements as shown in the FIG. 2, arranged in a back-to-back manner and secured together to form a two-seated picnic table arrangement.

Figure 5A:
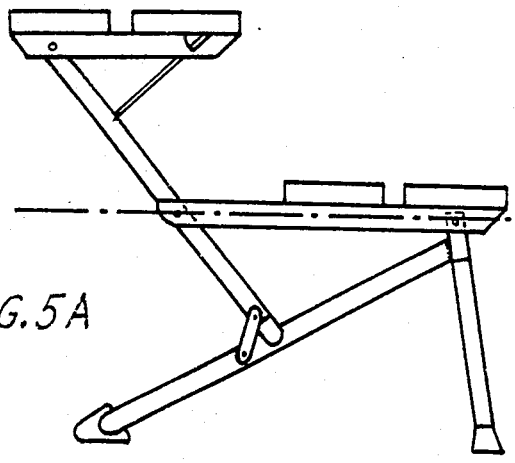
Figure 5B:
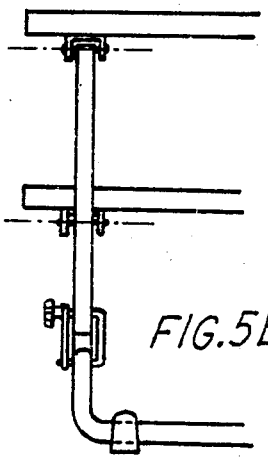
Figure 6A:
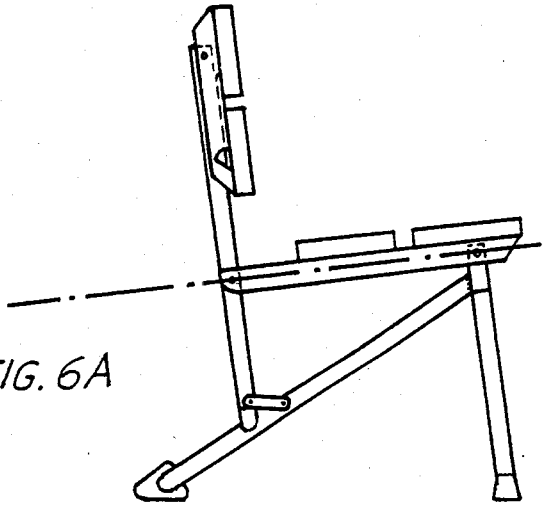
Figure 6B:
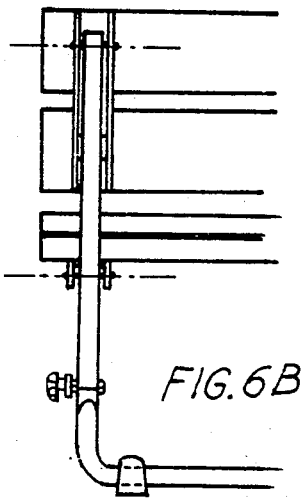
Figure 7:
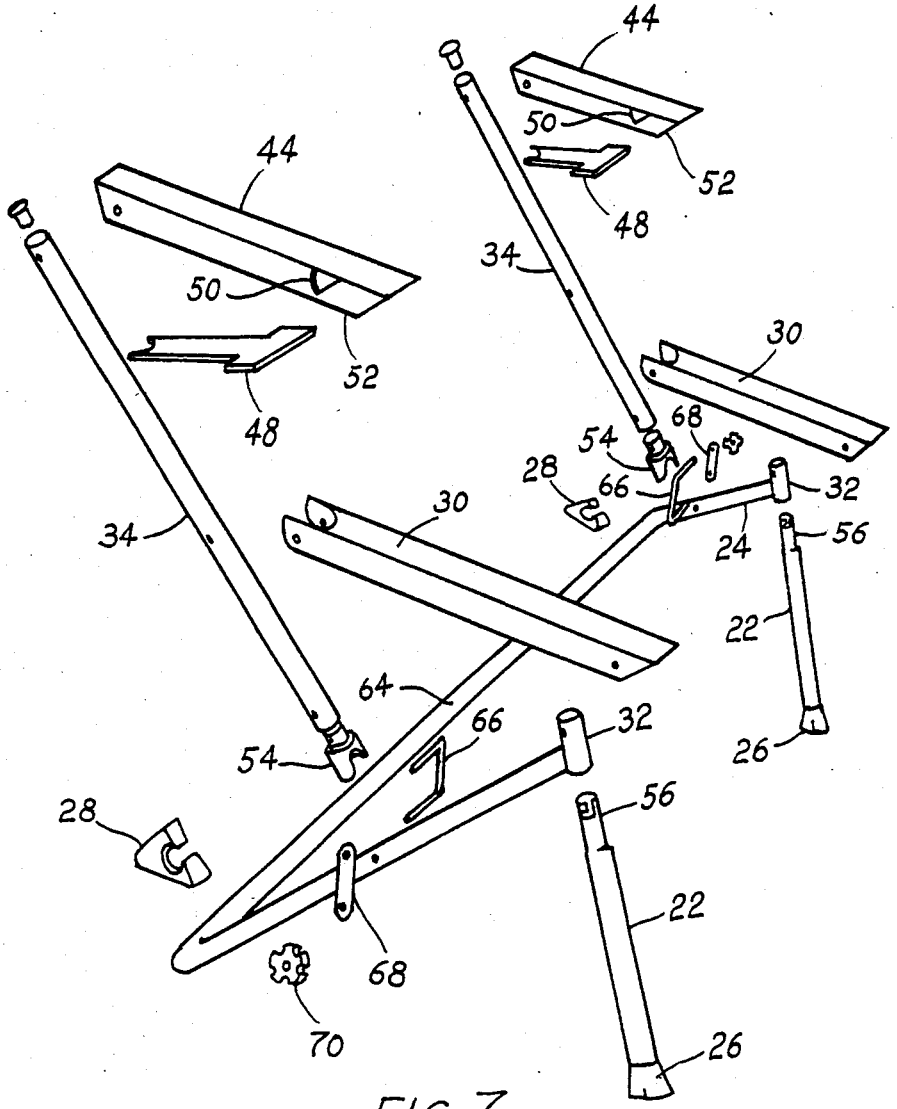

FIGS. 5A, 5B; 6A, 6B; and 7 show in greater detail a preferred, practical form of the seat/table arrangement of the earlier Figures; the FIGS. 5A and 6A being end elevations similar to those of the FIGS. 2 and 1 respectively, the FIGS. 5B and 6B being side elevations showing only one end portion of the arrangement, the other end portion being similar but reversed relative to that shown in the FIGS. 5B and 6B, and the FIG. 7 showing pictorially an exploded view of the various constituent parts that make up the framework.

Referring now to the FIG. 1, the bench seat there shown comprises two solid timber, transverse seat members 10,12 and two solid timber, transverse backrest members 14,16 carried on a framework that comprises two similar, transversely-spaced, metal, folding frames 18, of which only one is visible in the Figure.

Each such frame 18 comprises:

(a) a leg member 20 comprising front and rear legs 22,24 joined together rigidly uppermost at an included angle of approximately 56° and having lowermost ground-engaging foot portions 26,28;

(b) a seat member carrier 30 pivotally connected at the right-hand end thereof with the upper end 32 of leg member 20;

(c) an upright backrest support 34 pivotally connected intermediate its ends with the left-hand end 36 of the seat member carrier 30;

(d) a pair of transversely-spaced, parallel connecting links 38 straddling and pivotally connected to the lower end 40 of the backrest support 34, and straddling and pivotally connected to an intermediate portion 42 of the rear leg 24;

(e) a backrest carrier 44 pivotally connected at its upper end to the upper end 46 of the backrest support 34; and (f) a prop or stay 48 pivotally carried at its lower end in a pair of triangular slots 50 formed in parallel, transversely-spaced side portions 52 of the backrest carrier 44, and trapped between the rear faces of the backrest members 14,16, and the front surface of the backrest support 34.

The two seat members 10,12 are secured by screws (not shown) on the upper surfaces of the respective seat member carriers 30 of the two folding frames, and the two backrest members 14,16 are likewise secured by screws (not shown) to the respective backrest carriers 44 of the two frames in the manner shown.

The bottom ends 40 of the respective backrest supports 34 carry resilient buffers 54 which have their lower faces shaped to engage closely around the cylindrical external surfaces of the respective rear legs 24.

The ground-engaging parts 26,28 of the legs carry resilient foot pads.

The front and rear legs 22,24 and the backrest supports are of cylindrical, tubular construction.

In the configuration shown in the FIG. 1, with the connecting links 38 pivoted to their lefthand stable end-positions, the arrangement is in a stable condition for use as a seat or bench, for example, in the home or in the garden.

The seat members 10,12 are inclined slightly downward in a rearward direction, and the backrest members 14,16 and the backrest support 34 are inclined to the ground at an angle of approximately 85°.

The seat can be readily transformed into the seat/table arrangement that is shown in the FIG. 2, by first lifting upwardly and simultaneously moving rearwardly the backrest members 14,16 and backrest supports 34, so as to rotate the connecting links 38 in a clockwise direction to the first, stable end position, in which position the backrest support buffers 54 rest on the rear legs 24 at a position above the pivotal connections of the connecting links with the rear legs.

The backrest members 14, 16 and their carriers 44 are then pivotally raised away from the backrest supports 34, thus allowing the respective props 48 to fall under gravity to their lower end positions, as determined by the shapes of the triangular slots 50 in the carriers 44, and so support the backrest carriers 44 and members 14,16, when those parts are subsequently lowered to the backrest supports 34. This new condition is depicted in the backrest supports 34 are inclined to the ground at an angle of approximately 50° FIG. 2, from which it can be seen that the backrest members 14,16 now lie in a horizontal disposition and so serve as table-top members.

To collapse the seat/table arrangement of FIG. 2 for storage, that arrangement must first be collapsed to the bench seat configuration of FIG. 1, by reversing the procedure just described. That is, by taking the weight of the backrest members 14, 16 and associated carriers 44 whilst the props are collapsed against the members 14,16 so as to allow the backrest carriers to lie once again on the inclined backrest supports 34. The latter are then pulled rearwardly and simultaneously rotated forwardly. When the arrangement is restored to the seat configuration of FIG. 1, the connecting links 38 are removed from at least the lower ends 40 of the backrest supports 34, and the latter are then rotated in an anticlockwise direction and lowered on to the rear legs 24.

The front legs 22 are then detached from the upper parts 32 of the leg members 20, by undoing bayonet-type connecting parts at reference 56, whereupon the arrangement has the compact storage configuration illustrated in the FIG. 3, the detached front legs being available for storage separately from the rest of the seat/table arrangement. It will be appreciated that the collapsed configuration of the FIG. 3 will require relatively little storage space, whether it be in a car, or in a domestic storage area.

The juxtaposition of two similar seat/table arrangements of the kind shown in the FIG. 2, in a back-to-back manner, can readily provide an integral picnic table/-seat arrangement which can seat persons not only along both sides of the table top, but also on other, separate seats placed at the respective ends of the table top, there being available ample leg-room to accommodate persons sitting at the table ends.

Desirably, the two seat/table arrangements are secured together by wooden plates 58 secured by means of thumbscrews 60 under the table top members 14,16. Such plates may be provided with apertures 62 for receiving the shaft of a garden umbrella. Such a plate may also be fixed in position adjacent the middle of the table top to improve the rigidity of the table and provide a centrally-positioned aperture for an umbrella shaft.

Whereas in the arrangement so far described, two separate folding frames have been provided, in one preferred, practical arrangement those frames are united at ground level by an integral longitudinal member 64 which joins the lower ends of the rear legs 24. The details of such a preferred arrangement are shown in a self-explanatory manner in the various FIGS. 5A, 5B, 6A, 6B and 7.

In that preferred arrangement the connecting links 38 are constituted by a U-shaped link 66 which cooperates with a flat plate link 68. The free ends of the link 66 are received in apertures provided in the plate link 68, and a knurled nut 70 is arranged for screwing on one of the free ends of the link 66.

The front legs may in other arrangements be united by a transverse member, as in the case of the rear legs just referred to above, but in that case the bayonet-type connecting parts of the front legs are replaced by other forms of connecting parts.

The connecting links 38, 66 to 70, may be used as a securing means for securing the folding frames in the collapsed condition of FIG. 3. In that Figure the connecting lines are indicated at reference 70.

When the folding frames are joined by a transverse member such as 64 (FIG. 7), that member can provide a useful means of carrying the collapsed arrangement of FIG. 3, where the position of that member 64 is indicated by that reference numeral. Seats of much greater transverse length may use more than two folding frames 18. For example, three separate, transversely-spaced frames may be used; or two separate sets of framework as shown in the FIGS. 5 to 7 may be spaced transversely along the seat members 10,12.

I claim:

1. A seat of the folding or collapsible kind in which a transverse seat member is carried on a folding framework, wherein said framework comprises at least two similar, transversely-spaced folding frames, each such frame comprising (a) a leg member incorporating a front leg and a rear leg;

(b) a seat member carrier for receiving and supporting said transverse seat member, said carrier being pivotally connected to said leg member;

(c) a backrest support pivotally connected to said seat member carrier;

(d) a connecting link pivotally connected at one end thereof to said rear leg and at the other end thereof to said backrest support so as to allow the link to pivot between and occupy alternatively one of two alternative, different, stable positions;

(e) a backrest carrier pivotally connected to said backrest support;

(f) a prop pivotally connected to said backrest carrier and free to pivot between alternative first inoperative and second operative positions;

(g) a first of said connecting link stable positions being effective for maintaining each frame in a seat configuration in which said prop is in its first inoperative position and said backrest carrier and backrest support are in generally upright relationship to the horizontal; and (h) a second of said connecting link stable positions being effective for maintaining each frame in a table-top/bench configuration in which said prop is in its second operative position supporting said backrest support in generally parallel relationship to the horizontal and to said seat member carrier.

2. A seat of the folding or collapsible kind in which a transverse seat member is carried on a folding framework, wherein said framework comprises at least two similar, transversely-spaced folding frames, each such frame comprising (a) a leg member incorporating a front leg and a rear leg, which legs are secured together at one end, define between them a large acute angle, and have at their other ends respective ground-engaging foot portions which are spaced apart from one another to define the base area of the seat;

(b) a seat member carrier for receiving and supporting said transverse seat member, said seat member carrier being pivotally connected at a first pivot to said leg member near the junction of the front and rear legs;

(c) a backrest support pivotally connected at a second pivot intermediate its extremities to said seat member carrier at a position thereon remote from said first pivot and over-hanging said rear leg;

(d) a connecting link pivotally connected at one end thereof to said rear leg at a third pivot at a position thereon between said first pivot and said rear leg ground-engaging foot portion , and at the other end thereof to said backrest support at a fourth pivot position near the free end thereof which lies adjacent said rear leg, so as to allow the link to pivot between and occupy alternatively one of two alternative, different, stable end positions in which said free end of the backrest support compressively rests on said rear leg at opposite sides of said third pivot;

(e) a backrest carrier pivotally connected at a fifth pivot near one end thereof to said backrest support contiguous a free end thereof which lies remote from said seat member carrier and said connecting link;

(f) a prop pivotally connected at a sixth pivot to said backrest carrier at a position thereon remote from said fifth pivot , and free to pivot between alternative first inoperative and second operative positions, said prop when in said first position lying adjacent the backrest carrier, and when in said second position lying with its free end abutting and stably engaging the backrest support;

(g) a first of said connecting link stable positions being effective for maintaining each frame in a seat configuration in which said prop is in its first inoperative position and said backrest carrier and backrest support are in generally upright relationship to the horizontal; and (h) a second of said connecting link stable positions being effective for maintaining each frame in a table-top/bench configuration in which said prop is in its second operative position supporting said backrest support in generally parallel relationship to the horizontal and to said seat member carrier;

said transverse seat member being secured to and carried by each said seat member carrier at a position thereon such that the centre of gravity of that seat member lies at a position intermediate the first and second pivots; and wherein a transverse backrest member is secured to and carried by each said backrest carrier at a position thereon such that the centre of gravity of the backrest member lies at a position intermediate the fifth and sixth pivots.

3. A seat according to claim 1 wherein in each said folding frame said large acute angle between said front and rear legs lies in the range 45° to 90°.

4. A seat according to claim 3, wherein in each said folding frame said large acute angle between said front and rear legs lies in the range 50° to 80°.

5. A seat according to claim 4, wherein in each said folding frame said large acute angle between said front and rear legs is approximately 57°.

6. A seat according to claim 1, wherein the constituent members thereof are so proportioned that when said ground-engaging foot portions of said front and rear legs are engaged on a horizontal surface, the angle of inclination of each said backrest support to the said horizontal surface changes from approximately 50° to approximately 85° when said connecting links are caused to move from one of said stable end positions to the other of said stable end positions.

7. A seat according to claim 1, wherein at least one pair of like legs of adjacent folding frames are joined together by a transverse, ground-engaging member.

8. A seat according to claim 2, wherein in each said folding frame said large acute angle between said front and rear legs lies in the range 45° to 90°.

9. A seat according to claim 8, wherein in each said folding frame said large acute angle between said front and rear legs lies in the range 50° to 80°.

10. A seat according to claim 9, wherein in each said folding frame said large acute angle between said front and rear legs is approximately 57°.

11. A seat according to claim 2, wherein the constituent members thereof are so proportioned that when said ground-engaging foot portions of said front and rear legs are engaged on a horizontal surface, the angle of inclination of each said backrest support to the said horizontal surface changes from approximately 50° to approximately 85° when said connecting links are caused to move from one of said stable end positions to the other of said stable end positions.

12. A seat according to claim 3, wherein the constituent members thereof are so proportioned that when said ground-engaging foot portions of said front and rear legs are engaged on a horizontal surface, the angle of inclination of each said backrest support to the said horizontal surface changes from approximately 50° to approximately 85° when said connecting links are caused to move from one of said stable end positions to the other of said stable end positions.

13. A seat according to claim 4, wherein the constituent members thereof are so proportioned that when said ground-engaging foot portions of said front and rear legs are engaged on a horizontal surface, the angle of inclination of each said backrest support to the said horizontal surface changes from approximately 50° to approximately 85° when said connecting links are caused to move from one of said stable end positions to the other of said stable end positions.

14. A seat according to claim 5, wherein the constituent members thereof are so proportioned that when said ground-engaging foot portions of said front and rear legs are engaged on a horizontal surface, the angle of inclination of each said backrest support to the said horizontal surface changes from approximately 50° to approximately 85° when said connecting links are caused to move from one of said stable end positions to the other of said stable end positions.

15. A seat according to claim 8, wherein the constituent members thereof are so proportioned that when said ground-engaging foot portions of said front and rear legs are engaged on a horizontal surface, the angle of inclination of each said backrest support to the said horizontal surface changes from approximately 50° to approximately 85° when said connecting links are caused to move from one of said stable end positions to the other of said stable end positions.

16. A seat according to claim 9, wherein the constituent members thereof are so proportioned that when said ground-engaging foot portions of said front and rear legs are engaged on a horizontal surface, the angle of inclination of each said backrest support to the said horizontal surface changes from approximately 50° to approximately 85° when said connecting links are caused to move from one of said stable end positions to the other of said stable end positions.

17. A seat according to claim 10, wherein the constituent members thereof are so proportioned that when said ground-engaging foot portions of said front and rear legs are engaged on a horizontal surface, the angle of inclination of each said backrest support to the said horizontal surface changes from approximately 50° to approximately 85° when said connecting links are caused to move from one of said stable end positions to the other of said stable end positions.

18. A seat according to claim 2, wherein at least one pair of like legs of adjacent folding frames are joined by a transverse, ground-engaging member.

19. A seat according to claim 3, wherein at least one pair of like legs of adjacent folding frames are joined by a transverse, ground-engaging member.

20. A seat according to claim 8, wherein at least one pair of like legs of adjacent folding frames are joined by a transverse, ground-engaging member.

21. The seat as defined in claim 1 wherein said backrest support has opposite first and second ends respectively adjacent and pivotally connected to said rear leg and said backrest carrier, said backrest support first end bears against said rear leg at a point between said connecting link one end and a lower ground-engaging portion of said rear leg in said seat configuration, and said backrest support first end bears against said rear leg at a point between said connecting link one end and an upper portion of said rear leg in said table-top/bench configuration.

22. The seat as defined in claim 1 including means for automatically positioning said prop in the second position thereof at an angle of substantially 90° to said backrest support in said table-top/bench configuration thereby automatically maintaining said backrest carrier and said seat member carrier generally parallel to each other in said second of said connecting link stable positions.

23. The seat as defined in claim 1 wherein said prop has first and second ends, said prop first end being pivotally connected to said backrest carrier, and said prop second end being a terminal end in engagement with said backrest support in said table-top/bench configuration thereby maintaining said backrest carrier and said seat member carrier generally parallel to each other in said second of said connecting link stable positions.

24. The seat as defined in claim 1 wherein said prop has first and second ends, said prop first end being pivotally connected to said backrest carrier, and means for automatically positioning said prop at substantially 90° to said backrest support when said backrest carrier is generally parallel to said seat member carrier.

25. The seat as defined in claim 21 including means for automatically positioning said prop in the second position thereof at an angle of substantially 90° to said backrest support in said table-top/bench configuration thereby automatically maintaining said backrest carrier and said seat member carrier generally parallel to each other in said second of said connecting link stable positions.

26. The seat as defined in claim 21 wherein said prop has first and second ends, said prop first end being pivotally connected to said backrest carrier, and said prop second end being a terminal end in engagement with said backrest support in said table-top/bench configuration thereby maintaining said backrest carrier and said seat member carrier generally parallel to each other in said second of said connecting link stable positions.

27. The seat as defined in claim 21 wherein said prop has first and second ends, said prop first end being pivotally connected to said backrest carrier, and means for automatically positioning said prop at substantially 90° to said backrest support when said backrest carrier is generally parallel to said seat member carrier.

28. The seat as defined in claim 1 including means for nonpivotally connecting said front and rear legs to each other.

29. The seat as defined in claim 21 including means for nonpivotally connecting said front and rear legs to each other.

30. The seat as defined in claim 22 including means for nonpivotally connecting said front and rear legs to each other.

31. The seat as defined in claim 23 including means for nonpivotally connecting said front and rear legs to each other.

32. The seat as defined in claim 24 including means for nonpivotally connecting said front and rear legs to each other.

* * * * *